US011245227B2

(12) United States Patent
Schnieder

(10) Patent No.: US 11,245,227 B2
(45) Date of Patent: Feb. 8, 2022

(54) PLUG CONNECTION HAVING A LOCKING CLIP HAVING A CATCH, AND METHOD FOR LOCKING AND UNLOCKING A PLUG CONNECTION

(71) Applicant: HARTING ELECTRIC GMBH & CO. KG, Espelkamp (DE)

(72) Inventor: Stefan Schnieder, Bohmte (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/648,615

(22) PCT Filed: Sep. 7, 2018

(86) PCT No.: PCT/DE2018/100763
§ 371 (c)(1),
(2) Date: Mar. 18, 2020

(87) PCT Pub. No.: WO2019/057240
PCT Pub. Date: Mar. 28, 2019

(65) Prior Publication Data

US 2020/0227862 A1 Jul. 16, 2020

(30) Foreign Application Priority Data

Sep. 21, 2017 (DE) ..... 10 2017 121 868.8

(51) Int. Cl.
*H01R 13/629* (2006.01)
*H01R 13/502* (2006.01)
(Continued)

(52) U.S. Cl.
CPC ..... *H01R 13/62955* (2013.01); *H01R 13/502* (2013.01); *H01R 13/6275* (2013.01); *H01R 13/6397* (2013.01)

(58) Field of Classification Search
CPC ..... H01R 13/6397; H01R 13/62955; H01R 13/502
(Continued)

(56) References Cited

U.S. PATENT DOCUMENTS 4,303,292 A 12/1981 McNeel
5,823,809 A * 10/1998 Wakata ..... H01R 13/5202 439/157
(Continued)

FOREIGN PATENT DOCUMENTS

CN 1177221 A 3/1998
CN 1083623 C 4/2002
(Continued)

OTHER PUBLICATIONS

International Preliminary Report on Patentability, dated Mar. 24, 2020, for International Application No. PCT/DE2018/100763, 9 pages.
(Continued)

*Primary Examiner* — Neil Abrams
(74) *Attorney, Agent, or Firm* — Seed IP Law Group LLP

(57) ABSTRACT

A plug connector having two housings and a locking clip and a catch for locking and unlocking the two housings is provided, wherein the locking clip is rotatably mounted on one of the two housings. The catch comprises at least one part and is arranged on the locking clip. It has a folded-out position and a folded-in position. In addition, the catch has at least one articulated connection and is formed in the shape of a Z-beam or Z-support. The catch prevents inadvertent opening and closing of the locking clip with simultaneously simple handling for the user. Methods for locking and unlocking a plug connection are also provided. The catch 2 when folded down (FIG. 1) blocks the locking clip 1 against movement to an unlocked position. The catch 2 when folded
(Continued)

upward (FIG. 2) permits free motion of the locking clip 1 to the unlocked position to permit separation of the housings.

9 Claims, 2 Drawing Sheets

(51) Int. Cl.
*H01R 13/627* (2006.01)
*H01R 13/639* (2006.01)

(58) Field of Classification Search
USPC ..... 439/157
See application file for complete search history.

(56) References Cited

U.S. PATENT DOCUMENTS

| | | | | |
|---|---|---|---|---|
| 5,989,044 | A | 11/1999 | Miyamoto | |
| 6,056,582 | A | 5/2000 | Okabe | |
| 6,174,179 | B1 * | 1/2001 | Okabe | H01R 13/62955 439/157 |
| 6,319,050 | B1 * | 11/2001 | Miyazaki | H01R 13/62938 439/157 |
| 7,052,294 | B1 | 5/2006 | Osada | |
| 7,396,240 | B2 * | 7/2008 | Frederiksen | H01R 13/639 439/157 |
| 8,641,433 | B2 * | 2/2014 | Uchida | H01R 13/62955 439/157 |
| 10,218,116 | B1 * | 2/2019 | Muldowney | H01R 13/641 |
| 2020/0227862 | A1 * | 7/2020 | Schnieder | H01R 13/502 |

FOREIGN PATENT DOCUMENTS

| | | | |
|---|---|---|---|
| DE | 26 32 338 | C2 | 1/1982 |
| DE | 195 08 605 | C1 | 7/1996 |
| EP | 0 352 579 | A1 | 1/1990 |
| EP | 0 691 040 | B1 | 6/1997 |
| EP | 2410618 | A2 | 1/2012 |

OTHER PUBLICATIONS

European Patent Office, International Search Report for international application No. PCT/DE2018/100763, dated Nov. 30, 2018, 7 pages (with English translation).
German Patent Office, Office Action for German application No. 10 2017 121 868.8, dated May 3, 2018, 6 pages.
China National Intellectual Property Administation, Office Action for Chinese Application No. 201880061214.6; dated Oct. 9, 2020; 8 pages.

* cited by examiner

PLUG CONNECTION HAVING A LOCKING CLIP HAVING A CATCH, AND METHOD FOR LOCKING AND UNLOCKING A PLUG CONNECTION

BACKGROUND

Technical Field

The present disclosure is directed to a plug connection having a locking clip having a catch and related methods for locking and unlocking a plug connection.

Plug connectors or plug connections with locking clips are required in order to guarantee a reliable electrical contact and to prevent housings of the plug connection from being inadvertently pulled apart.

Furthermore, in order to guarantee a satisfactory pressure of the two plug connection halves, i.e., the two housings, against one another, a toggle lever action of the locking clip is required with plug connections of this type. With regard to the locking clip, this toggle lever action serves to make it possible to achieve the closed position with a defined end position in a relatively simple manner.

Description of the Related Art

It is known from DE 26 32 338 C2 that the locking clip should be bent out of sheet metal material in a U-shape, and the side parts should be provided with overlapping parts which overlap the locking pins of the other plug connection half during the locking. The mounting of the locking clip takes place via pins on the one plug connection half, which are guided in a slit-shaped opening in the side part and are held by a spring element.

Furthermore, it is known from EP 0 352 579 A1 that approximately semicircular spring elements should be provided on the locking clips, the lower end of which spring elements is held on bearing pins of the one plug connection half, and the top end of which spring elements, which is provided with a roller, slides over a locking pin of the other plug connection half during the locking of the plug connection, whereby the plug connection halves are pressed against one another in a resilient manner.

A multipole connector for a multicore cable is known from U.S. Pat. No. 4,303,292 A. In this case, the connector is a hermaphroditic connector with clips, wherein the clips serve the locking. For this purpose, each clip has locking arms which each end in a differential locking element and thus define a secure locking of the connector. Moreover, the connector provides an indication of the locked state.

DE 195 08 605 C1 discloses an electrical plug connection with one or two U-shaped locking clips, which are pivotable about bearing pins of the one plug connection half, wherein, in the locked plug connection, spring elements arranged on the side parts thereof overlap locking pins arranged on the other plug connection half, and wherein the top end of the spring elements overlaps the respective locking pins of the other plug connection half when closing the locking clip, and thus acts on the locking pins such that the two plug connection halves are pressed against one another in a resilient manner.

However, a disadvantage of the known solutions is that it is only with difficulty that the locking clips can be secured against unintentional opening.

In the priority patent application concerning the following application, the German Patent and Trademark Office researched the following prior art: U.S. Pat. No. 4,303,292 A.

BRIEF SUMMARY

According to embodiments of the present invention, a locking clip is provided which offers simple and at the same time effective protection against unintentional separation of two connected housings of a plug connection. This protection is also able to be produced in a simple and cost-effective manner.

Embodiments of the present invention relate to a locking clip having a catch for locking and unlocking two housings of a plug connection, wherein the locking clip is mounted on one of the two housings in a rotatable manner. The locking clip has a locked position and an unlocked position. The catch is arranged on the locking clip. It has at least one hinged connection, wherein the catch can adopt a folded-out position and a folded-in position, whereby the plug connection has a locked state and an unlocked state.

Again, embodiments of the present invention comprise a locking clip having an inventive catch for locking and unlocking two housings of a plug connection. The locking clip is mounted on one of the two housings in a rotatable manner and has a locked position and an unlocked position.

The inventive catch consists of or comprises at least one part and is arranged on the locking clip. It has a folded-out position and a folded-in position. Furthermore, the catch has at least one hinged connection.

Locking clips are well known in the prior art for locking and unlocking housings of plug connections, see printed documents DE 26 32 338 C2, EP 0 352 579 A1 and DE 195 08 605 C1 in this respect, for example. However, the known locking clips do not have any protection against unintentional opening, be it due to vibrations, environmental factors or negligence.

An advantage of the inventive catch of the present invention is that it has a folded-out and a folded-in position. In the folded-in position, two connected housings can be separated from one another or two separated housings can be connected. In this position, the catch does not influence the functionality of the locking clip. In the folded-out position, the catch prevents two separated housings from being plugged together and, even more importantly, prevents two connected housings from being separated. The catch completely blocks the locking clip from moving to the unlocked position.

The states of the plug connection are also defined by the positions of the catch and the locking clip. The plug connection is in a locked state when the locking clip is in the locked position and the catch is in the folded-out position. The unlocked state is defined by the unlocked position of the locking clip and the folded-in position of the catch.

A further advantage is that the catch is captive on the locking clip due to the mounting. It thus cannot get lost like a lock in the sense of a latch bolt. Likewise, the catch is mounted such that a loop, wire connection or the like is also not necessary to prevent a loss, since the catch hangs around during time of non-use. Having a loop, wire connection or the like can lead to further problems, such as a power transmission, for example, if the catch is made of metal and were to come into contact with a power source. This would result in the operator being at risk, which is avoidable. The inventive catch is therefore mounted on the locking clip in a fixed manner and thus also in a captive manner.

The catch preferably consists of a plastics material. Alternatively, the catch can consist of metal. It is important that the material used is stable against exerted forces, in particular compressive forces.

At least one hinged connection, ideally in the region of the mounting on the locking clip, is advantageous in order to move the catch from the folded-in position into the folded-out position, and vice versa, without much effort. If the hinged connection is arranged at this point, it is recommended that the catch is at least configured in one piece. A one-piece or two-piece configuration ensures that the catch can be produced in a simple, cost-effective manner. In an advantageous configuration, the catch can thus be mounted on the locking clip by the at least one hinged connection.

The catch and the locking clip advantageously each have at least one opening, through which a bolt or a lock or a wire can be inserted for securing the plug connection in the locked state. As a result, the locked state of the plug connection is not necessarily only secured by the locking clip and the catch. If necessary, it can additionally be doubly secured against unauthorized access or unintentional opening by a common device, such as a lock, a bolt, a wire or a seal.

In a particularly advantageous configuration, the at least one hinged connection is a swivel joint. The swivel joint is advantageous as it enables the rotating movement between the folded-in position and the folded-out position without much effort being required from the operator. A further advantage is the low wear and the simple manner in which a swivel joint can be produced in comparison to more complex hinge connections. This in turn serves to reduce costs.

Advantageously, according to some embodiments the catch is formed in the shape of a z-beam. Z-beams are known in the prior art primarily in the field of sectional steels. They possess the shape of a "Z" in cross section. The two parallel legs of the "Z" can be different lengths, or they can be the same length. The shape of the z-beam has the advantage for the catch that it can be placed seamlessly around the edges, i.e., the outer rims, of the locking clip in the folded-in position, and has a significantly increased stability in the folded-out position, for example compared with a straight bar. This shape increases the durability of the catch and thus also the locking clip.

In a particularly advantageous configuration, the two parallel legs of the z-beam are different lengths. This is particularly advantageous if the leg which is arranged remote from the housing in the folded-in position is shorter than the leg which is near to the housing. Owing to the shorter length, the one leg then terminates with the upper side, i.e., the side of the locking clip which is opposite the catch. This minimizes the risk of injury for the operator, since no additional edge or elevation is generated on the locking clip, but rather there is a smooth finish.

In an advantageous configuration, the catch consists of or comprises a first part and at least one second part. The first part and the at least one second part are connected to one another in order to prevent loss. Advantageously, the first part and the at least one second part are connected to one another via a hinge joint or alternatively a swivel joint. This combination of mounting by the swivel joint on the locking clip and the hinged connection between the first part and the at least one second part of the catch makes handling easier for the operator, without losing stability.

Moreover, embodiments of the invention relate to a method for locking a plug connection by way of a locking clip having a catch, which comprises:

plugging together two housings of a plug connection, moving the locking clip from an unlocked position into a locked position, and moving the catch from a folded-in position into a folded-out position.

Advantageously, the method may further comprise an additional securing of the catch by way of a wire or a sealing or a bolt or a lock. In this way, the catch and thus also the plug connection is optimally secured.

Furthermore, embodiments of the invention relate to a method for unlocking a plug connection by way of a locking clip having a catch, which comprises:

moving the catch from a folded-out position into a folded-in position, moving the locking clip from a locked position into an unlocked position, and separating the two housings of a plug connection.

The method may further comprise releasing the catch before moving the catch from the folded-out position into the folded-in position. Advantageously, releasing the catch is carried out before moving the catch from the folded-out position into the folded-in position, thus making it possible to release the catch if it has been secured by a wire or a bolt or a lock.

The aforementioned methods facilitate the correct process for connecting two housings to one another in a simple manner, or for separating them from one another in a reliable manner. They also thereby rule out an unintentional separation or connection of two housings.

BRIEF DESCRIPTION OF THE SEVERAL VIEWS OF THE DRAWINGS

An exemplary embodiment of the invention is depicted in the drawings and is explained in greater detail below. In the drawings.

The figures may contain partially simplified, schematic depictions. Identical reference symbols are used in part for similar but possibly not identical elements. Different views of the same elements could be scaled differently.

DETAILED DESCRIPTION

Figure 1:
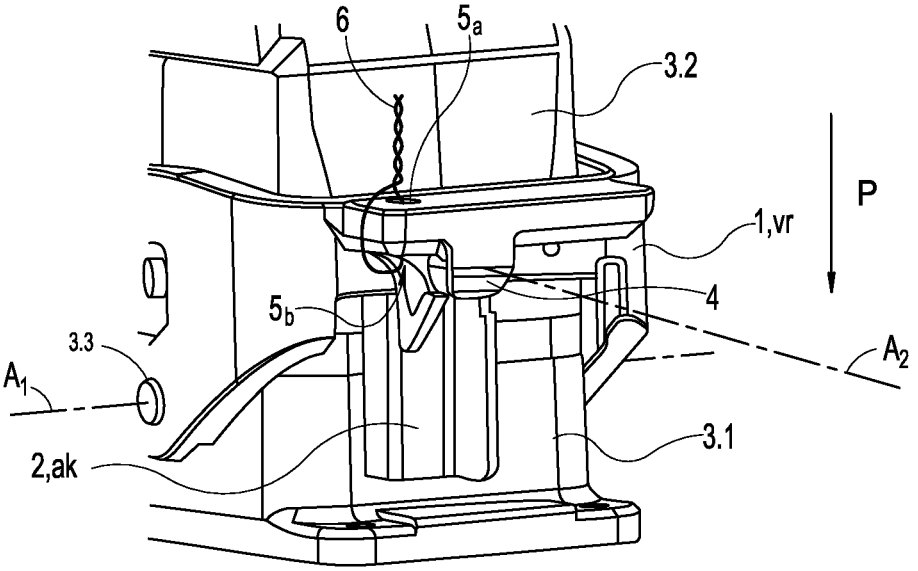
FIG. 1 shows a perspective depiction of a locking clip with a first variant of the inventive catch (folded out)

FIG. 1 shows a perspective depiction of a locking clip 1 which is mounted on a first housing 3.1 of a plug connection. The second housing 3.2 is also depicted. In all the figures, the first housing 3.1 is a so-called attachment housing which can be mounted on a machine, for example. In all the figures, the second housing 3.2 is depicted as a so-called socket housing. The machine is thereby supplied with power and/or control signals, for example. Of course, other types of housings which can be connected to one another are also conceivable.

The locking clip 1 is in a locked position vr and thus connects the two housings 3.1 and 3.2 to one another. To this end, the locking clip 1 is mounted on the first housing 3.1 in a rotatable manner about a clip axis of rotation $A^1$. In this example, the rotation takes place via so-called bearing pins 3.3 which are arranged on the first housing 3.1 and on which bearing pins 3.3 the locking clip 1 is mounted. In order to bring the locking clip 1 in the unlocked position, it must be moved in the direction of the first housing 3.1, i.e., downward in the plug-in direction represented by the arrow P, away from the second housing 3.2. The unlocked position is not shown in the figures.

In the unlocked position, the first housing 3.1 and the second housing 3.2 can be connected to one another or be separated from one another. A fixed connection between the first housing 3.1 and the second housing 3.2 is formed when the locking clip is in the locked position yr.

The inventive catch 2 is rotatably mounted on the locking clip 1 to rotate about a catch axis of rotation $A_2$, which is perpendicular to the clip axis of rotation $A_1$ and perpendicular to the plug-in direction P. In FIG. 1, this catch 2 is in the folded-out position ak wherein a free end of the catch 2 obstructs movement of the clip 1 to its unlocked position. The catch 2 is a z-beam-shaped object which is mounted on the locking clip 1 by a swivel joint 4.

Figure 2:
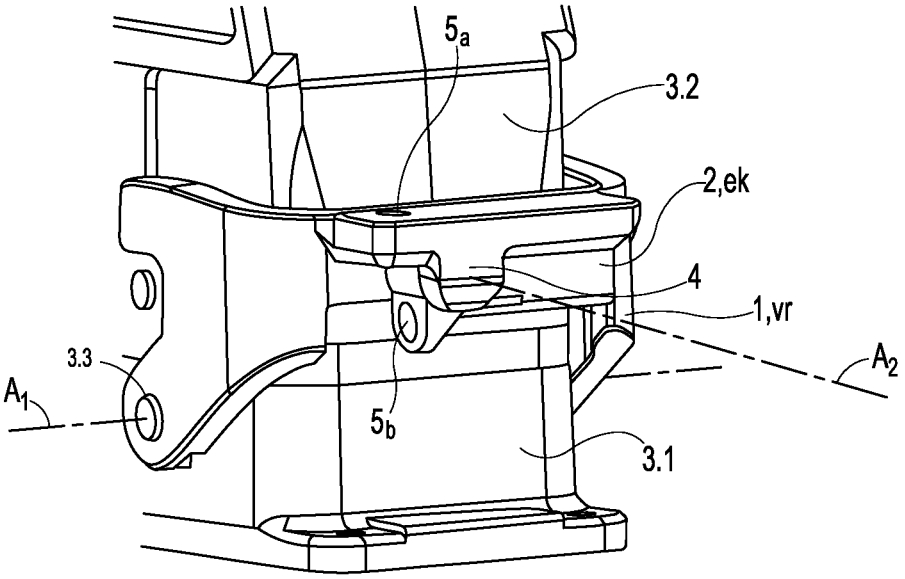
FIG. 2 shows a perspective depiction of the locking clip from FIG. 1 with a folded-in catch.

In the folded-in position ek, the catch 2 is attached to the locking clip 1 in an optimal manner by way of the z-beam-shaped configuration. This is shown in FIG. 2. The mounting of the catch 2 on the locking clip 1 significantly reduces the risk of injury for the operator, as well as the risk of damage to the catch 2.

The catch 2 can be moved between a folded-out position ak (FIG. 1) and a folded-in position ek (FIG. 2). The movement is made possible by a swivel joint 4. A different hinged connection is also conceivable for the movement between the two positions. The folded-in position ek is depicted in FIG. 2 for the first variant and in FIG. 4 for the second variant. By contrast, the folded-out position ak is shown in FIG. 1 for the first variant and FIG. 3 for the second variant.

With reference to FIGS. 1 and 2, the catch 2 is arranged on the locking clip 1, in the direction of the first housing 3.1. It can thus be used by the operator in one single movement together with locking or unlocking. Additional handles on the plug connection are dispensed with, which in turn saves time for the operator. Additionally, this arrangement also has the advantage that the catch 2 can interact with the side of the first housing 3.1 which can be added onto a wall, and thus further increases the catching action of the catch 2.

The catch 2 and the locking clip 1 each have an opening 5*a* 5*b* through which a bolt or a lock or a wire 6 can be inserted for securing the plug connection in the locked state. The two openings 5*a* 5*b* are in alignment with one another when the plug connection is in the locked state. In this exemplary embodiment, the two openings 5*a* 5*b* are arranged near to the swivel joint 4.

In FIG. 1 and FIG. 2, the catch 2 is made in one piece. A two-piece embodiment of the catch 2' is shown in FIGS. 3 and 4.

FIG. 2 shows the same plug connection with the same first and second housings 3.1 and 3.2 as FIG. 1. The locking clip 1 is in the locked position yr. The catch 2 is in the folded-in position ek, in which it is possible to open or, in the case of locking clips 1 which are still open, close the locking clip 1.

Here, the two openings lie at an angle to one another, since an additional securing is not necessary in the folded-in position ek.

Figure 3:
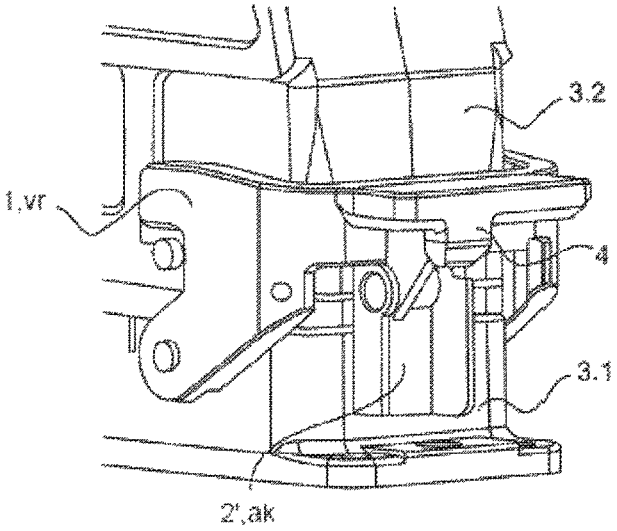
FIG. 3 shows a perspective depiction of a locking clip with a second variant of the inventive catch (folded out)
Figure 4:
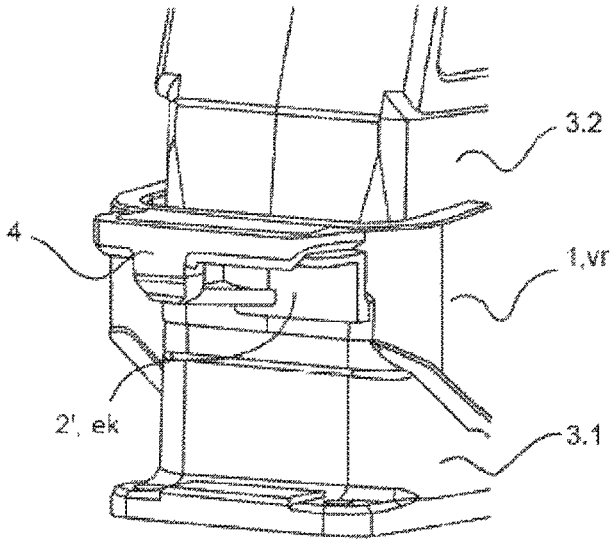
FIG. 4 shows a perspective depiction of the locking clip from FIG. 3 with a folded-in catch.

FIG. 3 likewise shows the same plug connection with the same first and second housings 3.1 and 3.2 as FIGS. 1 and 2. The locking clip 1 is in the locked position yr. The catch 2' is in the folded-out position ak. Opening or closing, depending on the position of the locking clip 1, is not possible in this position.

FIGS. 3 and 4 differ from FIGS. 1 and 2 by the configuration of the catch 2'. In FIG. 1 and FIG. 2, the catch 2 is made in one piece and is mounted on the locking clip 1 by a swivel joint 4. In FIG. 3 and FIG. 4, the catch 2' is also mounted on the locking clip 1 by a swivel joint 4, however the catch 2' is made in two pieces.

The first part and the second part of the catch 2' are connected to one another by a hinge joint. The connection is also conceivable by a further swivel joint. Convenience and accessibility when mounting or dismounting the first housing 3.1 can be improved for the operator by the additional hinge, in the event that said housing was not yet mounted/dismounted. This is because the catch 2' can also be unlatched in the folded-out position ak by way of the second hinge, in order to control the seal between the two housings 3.1 and 3.2, for example.

The catch 2' and the locking clip 1 each have an opening. The two openings are in alignment with one another when the plug connection is in the locked state. In this exemplary embodiment, the two openings are arranged as follows. The opening of the locking clip 1 is arranged on the side thereof. The opening of the catch 2' is arranged on the hinge joint, more specifically in an opening in the hinge joint.

In contrast to FIG. 3, FIG. 4 shows the two-piece catch 2' in the folded-in position ek. Other than that, the same plug connection with the same housings 3.1 and 3.2 as well as the locking clip 1 are shown. The locking clip 1 is also in the locked position vr in this figure.

Here, the two openings lie at an angle to one another, since an additional securing is not necessary in the folded-in position ek.

The configuration of the two-piece catch 2', as shown in FIGS. 3 and 4, is an alternative to the one-piece configuration of the catch 2. The one-piece embodiment is preferred if a high degree of stability is to be guaranteed. By contrast, the two-piece embodiment is the compromise between stability and accessibility.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug connection, comprising:

two housings; and a locking clip having a catch for locking and unlocking the two housings, wherein the locking clip is mounted on one of the two housings in a rotatable manner about a clip axis of rotation, wherein the catch has a base end and a free end opposite the base end, wherein the base end of the catch is coupled to the locking clip, wherein the catch has at least one hinged connection that defines a catch axis of rotation that is perpendicular to a plug-in direction of the plug connection and perpendicular to the clip axis of rotation, wherein the catch is movable about the catch axis of rotation between a folded-out position, in which the free end obstructs movement of the locking clip, and a folded-in position, in which movement of the locking clip is unobstructed by the catch, wherein the plug connection is in a locked state when the locking clip is in a locked position and the catch is in the folded-out position, wherein the plug connection is in an unlocked state when the locking clip is in an unlocked position and the catch is in the folded-in position, and wherein the catch is formed in a shape of a z-beam.

2. The plug connection as claimed in claim 1, wherein the catch is mounted on the locking clip in a captive manner.

3. The plug connection as claimed in claim 1, wherein the at least one hinged connection of the catch is a swivel joint.

4. The plug connection as claimed in claim 1, wherein the z-beam comprises two parallel legs that are different lengths.

5. The plug connection as claimed in claim 1, wherein the catch comprises a first part and at least one second part, and wherein the first part and the at least one second part are connected to one another via a hinge joint or a swivel joint.

6. A method for locking a plug connection having two housings via a locking clip having a catch, wherein the locking clip is mounted on one of the two housing in a rotatable manner about a clip axis of rotation, wherein the catch has a base end and a free end opposite the base end, wherein the base end of the catch is coupled to the locking clip, wherein the catch has at least one hinged connection that defines a catch axis of rotation that is perpendicular to a plug-in direction of the plug connection and perpendicular to the clip axis of rotation, wherein the catch is movable about the catch axis of rotation between a folded-out position, in which the free end obstructs movement of the locking clip, and a folded-in position, in which movement of the locking clip is unobstructed by the catch, wherein the plug connection is in a locked state when the locking clip is in a locked position and the catch is in the folded-out position, wherein the plug connection is in an unlocked state when the locking clip is in an unlocked position and the catch is in the folded-in position, and wherein the catch is formed in a shape of a z-beam, the method comprising:

plugging together the two housings of the plug connection, moving the locking clip from the unlocked position into the locked position, and moving the catch from the folded-in position into the folded-out position.

7. The method for locking a plug connection as claimed in claim 6, further comprising:

additional securing of the catch by way of a wire or a sealing or a bolt or a lock.

8. A method for unlocking a plug connection having two housings via a locking clip having a catch, wherein the locking clip is mounted on one of the two housing in a rotatable manner about a clip axis of rotation, wherein the locking clip has a base end and a free end opposite the base end, wherein the base end of the catch is coupled to the locking clip, wherein the catch has at least one hinged connection that defines a catch axis of rotation that is perpendicular to a plug-in direction of the plug connection and perpendicular to the clip axis of rotation, wherein the catch is movable about the catch axis of rotation between a folded-out position, in which the free end obstructs movement of the locking clip, and a folded-in position, in which movement of the locking clip is unobstructed by the catch, wherein the plug connection is in a locked state when the locking clip is in a locked position and the catch is in the folded-out position, wherein the plug connection is in an unlocked state when the locking clip is in an unlocked position and the catch is in the folded-in position, and wherein the catch is formed in a shape of a z-beam, the method comprising:

moving the catch from the folded-out position into the folded-in position, moving the locking clip from the locked position into the unlocked position, and separating the two housings of the plug connection.

9. The method for unlocking a plug connection as claimed in claim 8, further comprising:

releasing the catch prior to moving the catch from the folded-out position into the folded-in position.

* * * * *